United States Patent [19]

Rebske et al.

[11] Patent Number: 4,548,028

[45] Date of Patent: Oct. 22, 1985

[54] BEARING HOUSINGS FOR DRIVEN AND AIR-SUSPENDED SPINNING RINGS ON RING-SPINNING MACHINES AND RING-TWISTING MACHINES

[75] Inventors: Gunter Rebske; Manfred Voigt, both of Karl-Marx-Stadt, German Democratic Rep.

[73] Assignee: VEB Kombinat Textima, German Democratic Rep.

[21] Appl. No.: 477,797

[22] Filed: Mar. 22, 1983

[30] Foreign Application Priority Data

May 14, 1982 [DD] German Democratic Rep. ..... 2398510

[51] Int. Cl.[4] ..... D01H 7/58

[52] U.S. Cl. ..... 57/124; 57/75; 57/105; 57/122

[58] Field of Search ..... 57/75, 105, 101, 104, 57/122, 124

[56] References Cited

U.S. PATENT DOCUMENTS 3,543,503 12/1970 Watabe et al. ..... 57/124 X
4,114,359 9/1978 Creus ..... 57/124
4,302,927 12/1981 Hope, Sr. ..... 57/124 X

FOREIGN PATENT DOCUMENTS 11122 1/1956 German Democratic Rep. .
135408 5/1979 German Democratic Rep. .

*Primary Examiner*—John Petrakes
*Attorney, Agent, or Firm*—Nolte, Nolte and Hunter

[57] ABSTRACT

The invention relates to a bearing housing for driven and air-suspended spinning rings on ring-spinning and ring-twisting machines, whereby a tape drive with tensioning pulleys is provided for the spinning rings. The object of the invention is to decrease the amount of material and working time when the bearing housings are attached (applied) to the ring rail and to shorten the time required for the adjustment of the spinning rings and of the tensioning pulleys. The technical task which is being solved by the invention is constituted by the fact that the number of fastening elements needed for the attachment of the bearing housings to the ring rail is decreased and that the spinning rings are not individually adjusted and that the tensioning pulleys are not adjusted at all. According to the invention, this is accomplished by having at least two spinning rings (2;3) and one tensioning pulley (5) arranged on one bearing housing (1).

6 Claims, 3 Drawing Figures

BEARING HOUSINGS FOR DRIVEN AND AIR-SUSPENDED SPINNING RINGS ON RING-SPINNING MACHINES AND RING-TWISTING MACHINES

BACKGROUND OF THE INVENTION

The invention relates to the field of spinning and threading or twisting and pertains to a bearing housing for driven and air-suspended spinning rings on ring-spinning and ring-twisting machines, whereby a tape drive with tensioning pulleys is provided for the spinning rings.

Known is a bearing housing of the aforementioned type (prospectus for ring-spinning machine 2112 of the VEB Spinnereimaschinenbau Karl-Marx-Stadt; DD-WP No. 135,408; DD-AP No. 11122) wherein for each spinning ring, a bearing housing with four fastening elements is attached to the ring rail. Each spinning ring has to be adjusted during assembly. An air inlet is provided for each ring. The tensioning pulleys or rollers which bring about the required band-wrap-around are fastened to the ring rail in holding devices, after each second spinning ring. They run in ball bearings. The high number of rotation occuring at the tensioning pulleys (rollers) as a result of the driven spinning rings requires the use of bearings with great accuracy. Servicing these bearings is done through pulleys (rollers) in order to obtain the necessary band-wrap-around.

The fastening of the spinning rings in this manner has the disadvantage that it takes a lot of material and working time to attach the bearing housings to the ring rail. It also takes a lot of work to adjust the spinning rings and to connect the air supply for the spinning rings as does the adjusting of the tensioning pulleys (rollers). A further disadvantage is the necessity that the ring rail has a certain width in order to accommodate the bearing housings and the tensioning pulleys (rollers). The expense for the bearings is also a disadvantage when tensioning pulleys running in ball bearings are used. A further disadvantage is constituted by the expense for labor and lubricants for the servicing of these bearings. The great noise made by tensioning pulleys running in ball bearings is also a disadvantage.

SUMMARY OF THE INVENTION

It is an object of the invention to decrease the cost of material and labor during the attachment of the bearing housings to the ring rail and also to decrease the working time required for the adjustment of the spinning rings and of the tensioning pulleys (rollers).

It is a further object of the invention to decrease the number of fastening elements needed for the attachment of the bearing housings to the ring rail, to adjust the spinning rings not individually and to do away with the adjustment of the tensioning pulleys.

According to the invention, these objects are achieved by fastening at least two spinning rings and one tensioning pulley (roller) to a bearing housing. In a preferred embodiment, the tensioning pulley is air-suspended. The advantage of this is that the ring rail can be narrower due to the smaller diameters of the tensioning pulleys (rollers) and the incorporation of the fastening devices for the tensioning pulleys into the bearing housings. Saving the costs for the tensioning pulley bearings, saving on labor and auxiliary material for the servicing of the bearings, as well as the decrease of noise constitute further advantages. Another advantageous embodiment is one wherein an inlet bore for the air supply is provided on the bearing housing and wherein the ring conduits of the spinning rings are connected with each other by means of an air-supply conduit. This arrangement has the advantage that there are fewer places of attachment for the air supply and that, consequently, the working time is lessened for the connection of the air supply. In another advantageous embodiment, the distributor bore of the tensioning pulley is connected with one of the ring conduits of the spinning rings by means of an air-supply conduit. This embodiment has the advantage that no attachment or connecting point is provided for the air supply or inlet to the tensioning pulley, thus elminating the working time required for connecting the air supply.

BRIEF DESCRIPTION OF THE DRAWINGS

A preferred embodiment of the invention is illustrated in the accompanying drawings, in which.

DETAILED DESCRIPTION OF THE INVENTION

The arrangement is described with an example of a bearing housing for two spinning rings and one tensioning pulley.

Figure 1:
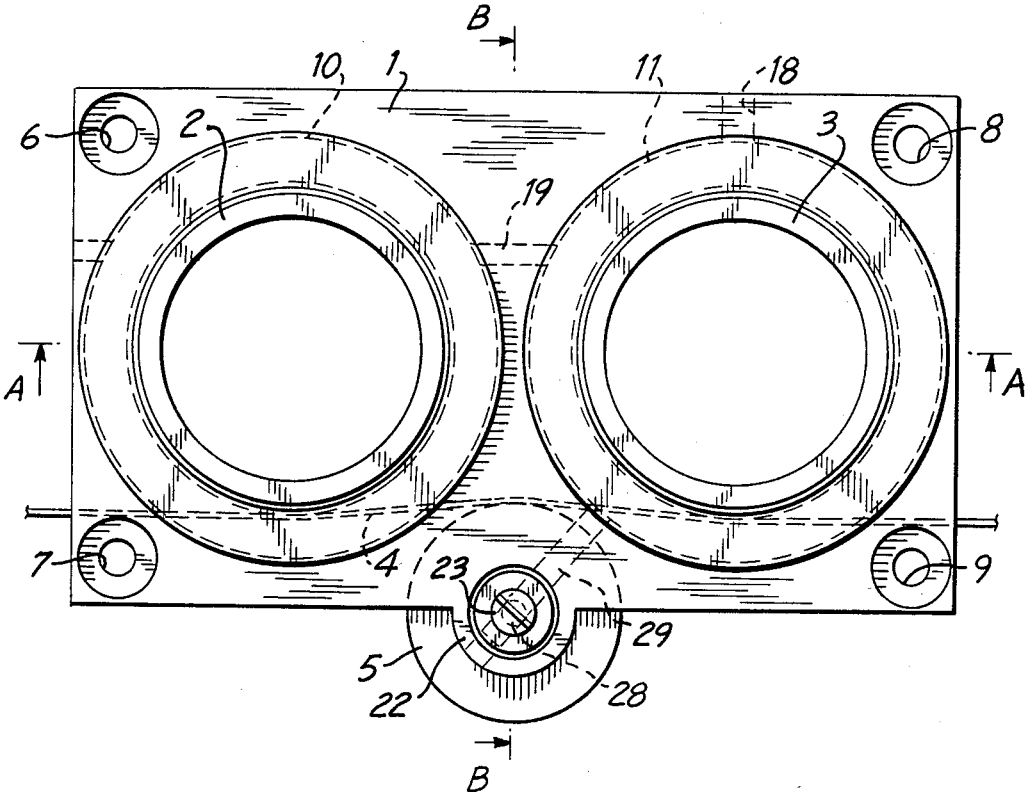
FIG. 1 is a top plan view of a bearing housing.
Figure 2:
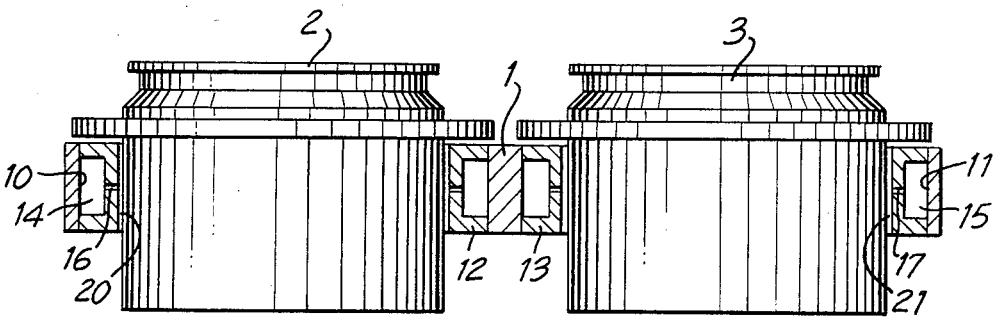
FIG. 2 is a section through A—A of FIG. 1.

Fastened to a ring rail, not shown, of a ring-spinning or a ring-twisting machine is a bearing housing 1 for driven and air-suspended spinning rings 2; 3 (FIG. 1). A tape drive 4 with tensioning pulleys 5 is provided for the spinning rings 2;3. The bearing housing 1 is fastened to the ring rail with four fastening elements. To this end, appropriate holes 6; 7; 8; 9 are provided in the bearing housing 1. Two spinning rings 2;3 and one tensioning pulley 5 are mounted on a bearing housing 1. Located in the bearing housing 1 are two borings 10;11 which accommodate the nozzle rings 12;13 (FIG. 2). The spinning rings 2;3 are rotatably located in the nozzle rings 12;13. Located in the nozzle rings 12,13 are the ring conduits 14;15 from which nozzles 16;17 emerge. The bearing housing 1 has an inlet bore 18 for the supply of air. The ring conduits 14;15 of the spinning rings 2;3 are connected to each other by means of an air-supply-conduit 19. The air is supplied by connecting the inlet bore 18 to a compressed-air line which is not illustrated here. The compressed air flows through ring conduit 15 and nozzle 17 and from ring conduit 15—via the air-supply conduit 19—into the ring canal 14 and its nozzles 16. An air gap 20;21 forms in a known manner at the spinning rings 2;3.

Figure 3:
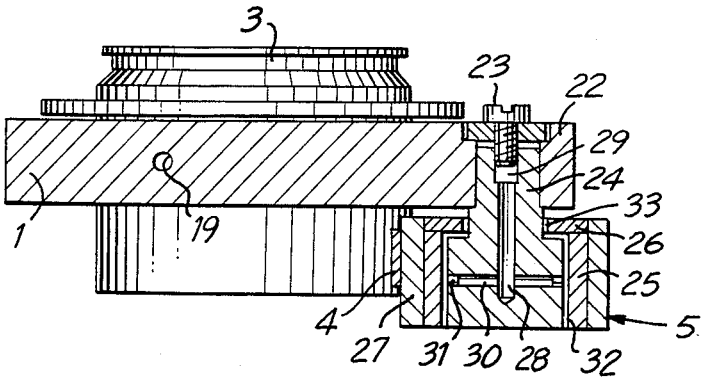
FIG. 3 is a section through B—B of FIG. 1.

The bearing housing 1 is so designed that the tensioning pulley 5 is located below a protrusion 22 of the bearing housing 1 and so that the same is fastened to the bearing housing 1 with a screw 23 (FIG. 3). The tensioning pulley 5 is air-suspended. It consists of a nozzle holder body 24 which is enclosed by a radial bushing; both are covered by an axial supporting disc 26. A casing or jacket 27 encompasses the radial bushing 25 and the axial supporting disc 26. Located in the nozzle holder body 24 is a distributor bore 28 which is closed from the top by the screw 23 which also serves, at the same time, as fastening device of the tensioning pulley 5 to the bearing housing 1. The distributor 28 of the tensioning pulley 5 is connected with the ring conduit 15 of the spinning ring 3 by means of an air-supply conduit 29.

In the lower part of the nozzle holder body 24, secondary cannals 30 run from the distributor bore 28, radially to the nozzles 31. When compressed air is applied, the same flows from the ring conduit 15—via the air-supply conduit 29—into the distributor bore 28 and from there—via the secondary conduits 30—to the nozzles 31. At the tensioning pulley 5, an air gap 32 forms between the nozzle holder body 24 and the axial supporting disc 26. Excess compressed air escapes through the exit gap 33.

When the invention is used, it is advantageous that the energy demand for the propulsion of the spinning rings is lowered. This is achieved because, as a result of the air suspension, all bearings—including those of the tensioning pulley—are very easily operable.

We claim:

1. In a bearing housing for driven and air-suspended spinning rings on the ring rails of ring-spinning and ring-twisting machines in which a tape drive with tensioning pulleys is provided for driving the spinning rings, the improvement comprising at least two spinning rings and one tensioning pulley arranged on said bearing housing, air means for air suspending said spinning rings in said housing, means mounting said tensioning pulley in said housing for tensioning said tape against the peripheries of said rings and means for mounting said housing on the ring rails of the ring-spinning and ring twisting machines.

2. In the bearing housing according to claim 1 in which said mounting means include means for air suspending said tensioning pulley.

3. In the bearing housing according to claim 2, wherein said means for air suspending said tensioning pulley comprises an air distributor boring in said mounting means, air conduit means in said mounting means which connects said distributor boring for fluid communication under pressure and an air gap formed between said tensioning pulley and said mounting means whereby said pulley is air suspended when air under pressure is provided to said air distributor bore.

4. In the bearing housing according to claim 3, wherein said means for air suspending said spinning rings comprise air-supply means for each said ring for air suspending said rings, air inlet means for supplying air directly to at least one of said ring air supply means, means for connecting said ring air supply means for each said ring in fluid communication, and an air-supply canal in said bearing housing which connects said air distributor boring in said mounting means for fluid communication with at least one of said air supply means, said air inlet means, and said means for connecting said ring air supply means.

5. In the bearing housing according to claim 4, wherein said air supply canal connects said air distributor boring and said at least one air supply means.

6. In thee bearing housing according to claim 1, said means for air suspending said spinning rings comprise air supply means for each said ring for air suspending the same, air inlet mans for supplying air directly to at least one of said ring air supply means, and means for connecting said ring air supply means for each said ring in fluid communication.

* * * * *